US011555381B2

(12) United States Patent
Davis et al.

(10) Patent No.: US 11,555,381 B2
(45) Date of Patent: Jan. 17, 2023

(54) RISERLESS OFFSHORE PRODUCTION AND STORAGE SYSTEM AND RELATED METHODS

(71) Applicant: ExxonMobil Upstream Research Company, Spring, TX (US)

(72) Inventors: Deborah J. Davis, League City, TX (US); Sushil K. Mandot, Bangalore (IN); David A. Baker, Bellaire, TX (US); Zhen Li, Houston, TX (US); Brian J. Fielding, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/647,486

(22) Filed: Jan. 10, 2022

(65) Prior Publication Data

US 2022/0243565 A1 Aug. 4, 2022

Related U.S. Application Data

(60) Provisional application No. 63/145,028, filed on Feb. 3, 2021.

(51) Int. Cl.
*E21B 43/01* (2006.01)

(52) U.S. Cl.
CPC ..... *E21B 43/01* (2013.01)

(58) Field of Classification Search
CPC ..... E21B 43/01; E21B 43/0122
See application file for complete search history.

(56) References Cited

U.S. PATENT DOCUMENTS

| | | | | |
|---|---|---|---|---|
| 3,643,447 | A * | 2/1972 | Pogonowski | B65D 88/78 166/351 |
| 5,050,680 | A * | 9/1991 | Diehl | E21B 43/0122 166/356 |
| 8,833,459 | B2 * | 9/2014 | O'Malley | E21B 43/0122 166/344 |
| 8,905,678 | B2 * | 12/2014 | Loladze | E21B 43/01 405/210 |
| 9,441,461 | B2 * | 9/2016 | Williams | E21B 41/0007 |
| 10,738,572 | B2 * | 8/2020 | Alqahtani | E21B 43/01 |

* cited by examiner

*Primary Examiner* — Matthew R Buck
(74) *Attorney, Agent, or Firm* — ExxonMobil Upstream Research Company—Law Department

(57) ABSTRACT

A method of conveying a production fluid from an offshore subsea well to an offshore vessel includes deploying an inflatable bladder from the offshore vessel, the inflatable bladder including a bladder valve, and fluidly connecting the inflatable bladder to an offloading port positioned at a seafloor, wherein the offloading port includes a port valve and is in fluid communication with one or more subterranean hydrocarbon-bearing formations. The method further includes opening the bladder and port valves to discharge the production fluid from the offloading port into the inflatable bladder, and thereby resulting in a substantially filled bladder, closing the bladder and port valves, and fluidly disconnecting the substantially filled bladder from the offloading port.

25 Claims, 1 Drawing Sheet

RISERLESS OFFSHORE PRODUCTION AND STORAGE SYSTEM AND RELATED METHODS

CROSS-REFERENCE TO RELATED APPLICATION

This application claims the benefit of U.S. Provisional Application 63/145,028, filed Feb. 3, 2021, the disclosure of which is hereby incorporated by reference in its entirety.

FIELD OF THE INVENTION

This application relates to subsea oil and gas production and, more particularly, to using inflatable bladders to transport production fluids from the seafloor to an offshore vessel.

BACKGROUND OF THE INVENTION

Oil and gas exploration and production is increasingly being undertaken in deeper and deeper offshore waters. Offshore and subsea oil and gas production systems, for example, have been qualified and applied at water depths of up to and exceeding 2500 meters. However, there are various challenges associated with deep water production and processing systems, and it is desirable to develop solutions that can enable efficient production from deep water fields.

Conventional offshore oil and gas production systems commonly consist of a subsea production system arranged on the seafloor and operable to collect hydrocarbons from one or more subterranean formations. Various flowlines and risers extend from the subsea production system to fluidly communication with an offshore vessel, such as a floating production storage and offloading vessel (FSPO). Produced hydrocarbons are conveyed from the subsea production system to the offshore vessel via the flowlines and risers.

As the water depth in offshore operations increases, the design of the offshore vessel will typically remain unchanged, but the design of the subsea production system will need to change to accommodate increases in hydrostatic pressure rating. Riser designs and pressure containment within flowlines and risers in deep water fields have also become increasingly challenging and even cost prohibitive with deeper water depth.

SUMMARY OF THE INVENTION

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In some embodiments, a method of conveying production fluid from an offshore subsea well is disclosed and may include a) deploying an inflatable bladder from an offshore vessel, the inflatable bladder including a bladder valve, b) fluidly connecting the inflatable bladder to an offloading port positioned at a seafloor, wherein the offloading port includes a port valve and is in fluid communication with one or more subterranean hydrocarbon-bearing formations, c) opening the bladder and port valves to discharge production fluid from the offloading port into the inflatable bladder, and thereby resulting in a substantially filled bladder, d) closing the bladder and port valves, and e) fluidly disconnecting the substantially filled bladder from the offloading port.

In some embodiments, an offshore production and storage system is disclosed and may include a) an offshore vessel including a storage containment unit, b) an inflatable bladder deployable from the offshore vessel and including a bladder coupling and a bladder valve, and c) an offloading port arranged at a seafloor and in fluid communication with one or more hydrocarbon-bearing reservoirs located below the seafloor, the offloading port including a port coupling and a port valve, wherein the bladder coupling is connectable to the port coupling and the bladder and port valves are actuatable to allow production fluids from the one or more hydrocarbon-bearing reservoirs to flow into the inflatable bladder, thereby resulting in a substantially filled bladder.

BRIEF DESCRIPTION OF THE DRAWINGS

The following figures are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

DETAILED DESCRIPTION OF THE INVENTION

This application relates to subsea oil and gas production and, more particularly, to using inflatable bladders to transport production fluids from the seafloor to an offshore vessel.

Embodiments of the present disclosure eliminate the need for a flowlines or risers extending between the seafloor and an offshore vessel for hydrocarbon production, and water depth may not be a limiting factor. Rather than using flowlines and risers to transport a reservoir product stream (e.g., production fluids) from subsea to topside, the embodiments described herein utilize inflatable bladders to achieve the same function. As described herein, subsea trees may collect and send production fluids to a subsea offloading port, and the inflatable bladders may be connectable to the offloading port and filled with production fluids. Filled or substantially filled inflatable bladders may then be disconnected from the offloading port and conveyed topside either by themselves (e.g., under buoyancy forces), with the help of a guiding wire, or with the help of an underwater vehicle. The filled bladders may then be connected to an offshore vessel which receives the stored production fluids, following which the emptied inflatable bladder may again be conveyed to the seafloor and the process repeated. Embodiments described herein may be advantageous in reducing flow assurance issues. Moreover, due to the limited infrastructure compared to conventional subsea production systems, the principles disclosed herein may also constitute a promising solution for early production systems.

Figure 1:
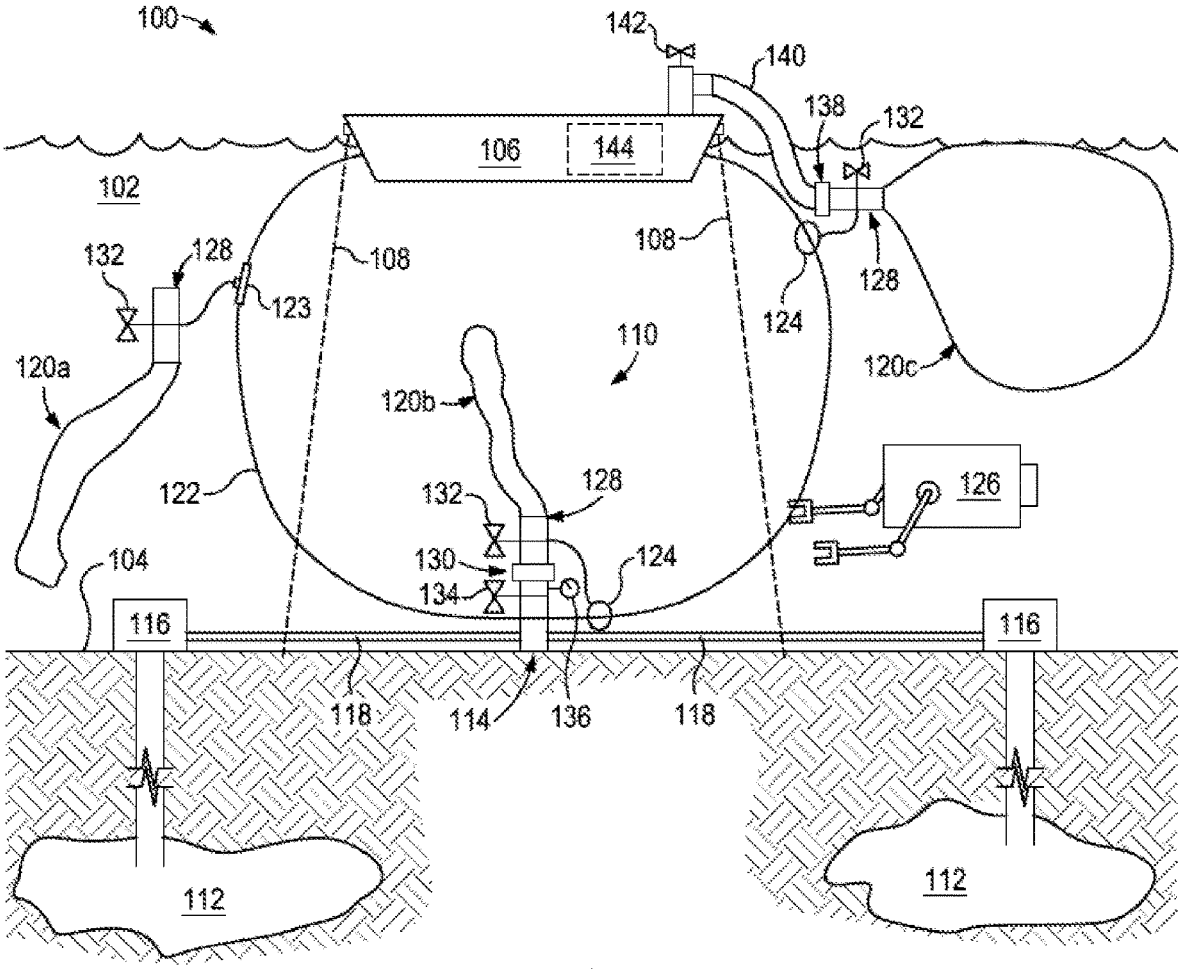
FIG. 1 is a schematic diagram of an example offshore production and storage system, according to one or more embodiments.

FIG. 1 is a schematic diagram of an example offshore production and storage system 100, according to one or more embodiments. In some embodiments, the offshore production and storage system 100 (hereafter "the system 100") may be used and operated in any offshore environment. As described herein, for example, the system 100 may be used in an offshore oceanic environment that includes a body of seawater 102 and a seafloor 104. In other embodiments, however, the system 100 could alternatively be used in any freshwater offshore application, without departing from the scope of the disclosure.

As illustrated, the system 100 may include an offshore hydrocarbon handling vessel 106. In some embodiments, the offshore hydrocarbon handling vessel 102 (hereafter the "offshore vessel 106") may comprise a floating vessel anchored to the seafloor 104 with one or more tethers 108 (shown in dashed lines). In such embodiments, the offshore vessel 102 may comprise, but is not limited to, a floating production, storage, and offloading (FPSO) vessel, a floating storage and offloading (FSO) vessel, a semisubmersible platform, a floating platform (e.g., a spar), a tension leg platform, or any combination thereof. In other embodiments, however, the offshore vessel 102 may comprise an untethered vessel, such as a floating barge, a transport vessel, a fixed platform, or a compliant tower, without departing from the scope of the disclosure.

The system 100 may also include a subsea production system 110 arranged at the seafloor 104 and configured to collect production fluids (e.g., hydrocarbons or a reservoir product stream) from one or more hydrocarbon-bearing reservoirs 112 (e.g., subsurface oil reservoirs) and convey the production fluids to the offshore vessel 102. More specifically, the subsea production system 110 may include an offloading port 114 and one or more subsea trees 116 (two shown) fluidly coupled to the offloading port 114 using one or more pipelines or conduits 118. The subsea trees 116 may be installed at corresponding wellheads (not shown) arranged on the seafloor 104 and operable to monitor and control the production of hydrocarbons (i.e., crude oil, natural gas, etc.) from the corresponding hydrocarbon-bearing reservoirs 112 located below the seafloor 104.

In some embodiments, as illustrated, the offloading port 114 may be arranged on and secured directly to the seafloor 104. In such embodiments, the offloading port 114 may comprise a central gathering point for hydrocarbons circulating through the several subsea trees 116 included in the system 100. In other embodiments, however, the offloading port 114 may be arranged on or secured to one of the subsea trees 116, without departing from the scope of the disclosure.

In conventional offshore production and storage systems, production fluids (hydrocarbons) are transported (conveyed) from subsea to offshore vessels using flowlines or risers extending between the seafloor and the receiving offshore vessel. According to embodiments of the present disclosure, however, the system 100 may achieve the same function using one or more inflatable bladders, shown in FIG. 1 as a first bladder 120*a*, a second bladder 120*b*, and a third bladder 120*c*. Briefly, the subsea trees 116 may collect and convey production fluids to the offloading port 114, and the inflatable bladders 120*a-c* may be individually or sequentially conveyed from the offshore vessel 106 to the seafloor 104. At the seafloor 104, each bladder 120*a-c* may be fluidly coupled to the offloading port 114 and filled with production fluid (hydrocarbons). The filled bladder 120*a-c* may then be disconnected from the offloading port 114 and transported (conveyed) back to the surface to be fluidly coupled to the offshore vessel 106, which receives the production fluids contained within the bladder 120*a-c*, following which the process can start anew.

While three inflatable bladders 120*a-c* are depicted in FIG. 1, more or less than three bladders 120*a-c* may be employed in the system 100, without departing from the scope of the disclosure. Those skilled in the art will readily appreciate, however, that employing multiple bladders may enhance the production continuity and rate between the offloading port 114 and the offshore vessel 106. When using multiple bladders 120*a-c*, for instance, the system 100 may be configured such that as a filled or substantially filled bladder 120*a-c* ascends toward the surface, an empty or substantially empty bladder 120*a-c* may be staged and ready for docking and connection at the offloading port 114.

As depicted in FIG. 1, the first and second inflatable bladders 120*a,b* are empty or substantially empty of production fluid, and the third inflatable bladder 120*c* is full or substantially full of production fluid. Moreover, the first bladder 120*a* is in the process of descending to the offloading port 114 from the offshore vessel 106, and the second bladder 120*b* is fluidly coupled to the offloading port 114 and in the process of receiving production fluid. The third bladder 120*c* is full or substantially full of production fluid and has ascended from the seafloor 104 to be fluidly coupled to the offshore vessel 106 for dispensing (discharging) the stored production fluid to the offshore vessel 106.

In some embodiments, the system 100 may include a guide wire 122 extending between the offshore vessel 106 and the offloading port 114. In such embodiments, the bladders 120*a-c* may be conveyed between the offshore vessel 106 and the offloading port 114 on the guide wire 122, which ensures that the bladders 120*a-c* are properly conveyed to and from each location. In some embodiments, one or more of the bladders 120*a-c* may be rigidly coupled to the guide wire 122. In the illustrated embodiment, for example, the first bladder 120*a* is depicted as being rigidly coupled to the guide wire 122 at a connector 123. In such embodiments, the guide wire 122 may be actuatable and movable to circulate the guide wire 122 between the offshore vessel 106 and the offloading port 114 and in the process convey the first bladder 120*a* from the offshore vessel 106, to the offloading port 114, and subsequently back to the offshore vessel 106.

In other embodiments, however, the guide wire 122 may be static or stationary (i.e., not able to circulate) and one or more of the bladders 120*a-c* may be freely coupled to the guide wire 122 and otherwise able to traverse (e.g., move up and down) the guide wire 122 between the offshore vessel 106 and the offloading port 114. In the illustrated embodiment, for example, the second and third bladders 120*b,c* are depicted as being freely coupled to the guide wire 122 at corresponding rings 124 that encircle the guide wire 122 and are configured to traverse the guide wire 122 as the bladders 120*b,c* move through the seawater 102. In such embodiments, gravitational forces may be sufficient to urge the empty or substantially empty bladders 120*b,c* toward the offloading port 114. More specifically, the empty or substantially empty bladder may exhibit a specific gravity greater than the specific gravity of the seawater 102. In contrast, buoyancy forces may urge the filled or substantially filled bladders 120*b,c* to ascend through the seawater 104 to the offshore vessel 106. More specifically, as the bladders 120*b,c* expand and fill with production fluid (e.g., oil), which has a low specific gravity (<1), buoyancy forces acting on the bladders 120*b,c* will correspondingly increase and naturally draw the bladders 120*b,c* toward the surface of the seawater 102.

In yet other embodiments, the freely coupled second and third bladders 120*b,c* may be moved along the guide wire 122 using one or more underwater vehicles 126, such as a remotely operated vehicle (ROV) or an autonomous underwater vehicle (AUV). In such embodiments, the underwater vehicle 126 may be configured to quickly and efficiently move the empty bladders 120*b,c* from the offshore vessel 106 to the offloading port 114 and subsequently back to the offshore vessel 106 once full. Moreover, in some embodiments, use of the underwater vehicle 126 may eliminate the need for the guide wire 122. Instead, the underwater vehicle 126 may employ electronic (e.g., sensors, beacons, etc.), visual (e.g., cameras and lights), or other location assistance measures to move the bladders 120*b,c* between the offloading port 114 and the offshore vessel 106 without the need to follow the guide wire 122.

For the system 100 to properly work, the bladders 120*a-c* need to be able to accurately dock with both the offloading port 114 and the offshore vessel 106. Several commonly used docking techniques may be employed to accomplish this. Such techniques include, but are not limited to, guide posts, stabbing guides, alignment assistance devices, or any combination thereof. Docking the bladders 120*a-c* to the offloading port 114 and the offshore vessel 106 may be done with or without the assistance of the underwater vehicle 126 or other sensing tools (e.g., visual, acoustic, etc.). Physical docking aides, such as guide posts, stabbing guides, etc., may facilitate alignment of conduits for production stream transfer and ensure that conduits can connect with structural and pressure integrity. Physical docking aides may not be necessary, however, if sensors or other electromechanical alignment aides are used and ensure that the fluid transfer conduits properly align and connect. Representative docking aides in accordance with the present disclosure can be borrowed from subsea template seafloor hardware or more advanced systems commonly used in spacecraft or submarine docking with airlock ports.

To be able to flow production fluids (hydrocarbons) into the empty or substantially empty bladders 120*a-c*, the bladders 120*a-c* need to be placed in fluid communication with the offshore port 114. To accomplish this, each bladder 120*a-c* may include a bladder coupling 128 matable with a port coupling 130 provided by the offloading port 114. The couplings 128, 130 may comprise mechanical couplings, electromechanical couplings, magnetic couplings, or any other type of coupling capable of achieving structural and pressure integrity of the connection between the bladder 120*a-c* and the offloading port 114. In some embodiments, the couplings 128, 130 may comprise compatible, pressure containing couplings that prevent the accidental discharge of hydrocarbons into the surrounding environment.

In some embodiments, securing the connection between the bladder 120*a-c* and the offloading port 114 at the couplings 128, 130 may be achieved with the help of the underwater vehicle 126. In other embodiments, however, the couplings 128, 130 may comprise electromechanical couplings capable of being remotely actuated and secured. The subsea connection at the couplings 128, 130 can be established in a manner similar to other subsea hardware; e.g., via locking pins, rotation sequencing, etc., which ensures that mating pieces of the couplings 128, 130 have properly engaged.

To allow production fluids (hydrocarbons) to flow from the offloading port 114 into the bladder 120*a-c*, one or more valves may be actuated. More specifically, the bladder coupling 128 may include a bladder valve 132 and the port coupling 130 may include a port valve 134. The bladder valve 132 may be actuatable between an open position, where fluid communication into or out of the given bladder 120*a-c* is allowed, and a closed position, where fluid communication is prevented. One side of the bladder valve 132 is exposed to the interior of the given bladder 120*a-c*, and the other side of the bladder valve 132 is fluidly connectable to the port coupling 130. The port valve 134 may be actuatable between an open position, where production fluids may be discharged out of the offloading port 114, and a closed position, where the production fluids are prevented from escaping the offloading port 114. Accordingly, one side of the port valve 134 is fluidly coupled to the hydrocarbon-bearing reservoirs 112 via the conduits 118 and the subsea trees 116, and the other side of the port valve 134 is configured to receive and connect to the bladder coupling 128 of each bladder 120*a-c*.

Upon properly docking a given bladder 120*a-c* at the offloading port 114 and securing the bladder and port couplings 128, 130, the valves 132, 134 may be actuated to commence the flow of production fluid (hydrocarbons) into the given bladder 120*a-c* from the offloading port 114. In some embodiments, the valves 132, 134 may be mechanically or electromechanically actuated from a remote location (e.g., on the offshore vessel 106). In such embodiments, once it is determined that the couplings 128, 130 are properly secured, actuation of the valves 132, 134 may be remotely triggered either automatically or through user intervention. In other embodiments, the underwater vehicle 126 may be designed to manually actuate the valves 132, 134, as needed.

In some embodiments, the valves 132, 134 may comprise a type of isolation valve configured to fully isolate the subsea systems without leaks. Moreover, the valves 132, 134 may be designed and otherwise rated for deep sea operation that enables sufficient pressure integrity to keep the seawater from entering the bladders 120*a-c* when the bladder valve 132 is closed, and preventing hydrocarbons from escaping the offloading port 114 when the port valve 134 is closed. Moreover, disconnecting the bladders 120*a-c* from the offloading port 114 may also be accomplished without hydrocarbons exiting the bladder 120*a-c* or the offloading port 114. In such embodiments, the valves 132, 134 may comprise back pressure valves or pressure activated gate valves that can perform under high pressure service.

The bladders 120*a-c* may be filled at the offloading port 114 until full or substantially full of production fluid. In some embodiments, one or more pressure sensors 136 may be included in the subsea production system 110 and may be configured to monitor the pressure of the bladders 120*a-c* being filled at the offloading port 114. In such embodiments, once a predetermined pressure is achieved within the bladder 120*a-c*, the valves 132, 134 may be actuated (either manually or automatically) to close and thereby stop the flow of production fluid. In other embodiments, the pressure sensor(s) 136 may be replaced with a flow meter and the bladder 120*a-c* may be filled until achieving a predetermined volume at which point the valves 132, 134 may be actuated to close and thereby stop the flow of production fluid.

Once the bladder 120*a-c* is filled to a sufficient volume and the valves 132, 134 are closed, the couplings 128, 130 may be disengaged either manually (e.g., with the underwater vehicle 126) or automatically (e.g., via remote operation). Upon disengaging from the offloading port 114, the filled or substantially filled bladder 120*a-c* may ascend toward the offshore vessel 106 for discharging. In some embodiments, as mentioned above, the buoyancy forces of the low specific gravity (<1) production fluid may cause the filled or substantially filled bladder 120*a-c* to naturally ascend through the seawater 104 to the offshore vessel 106 as guided by the guide wire 122. In other embodiments, however, the underwater vehicle 126 may alternatively be used to help convey the filled or substantially filled bladder 120*a-c* to the offshore vessel 106, either along the guide wire 122 or without the aid of the guide wire 122.

To convey the stored production fluid (hydrocarbons) from the filled or substantially filled bladders 120*a-c* to the offshore vessel 106, the bladders 120*a-c* need to be placed in fluid communication with the offshore vessel 106. To accomplish this, the bladder coupling 128 may be matable with a vessel coupling 138 provided by the offshore vessel 106. Similar to the couplings 128, 130, the coupling 138 may comprise a mechanical coupling, an electromechanical coupling, a magnetic coupling, or any other type of coupling capable of achieving structural and pressure integrity of the connection between the bladder 120*a-c* and the offshore vessel 106. Accordingly, the bladder, port, and vessel couplings 128, 130, 138 may all comprise a similar type of coupling compatible with each other for easy coupling and decoupling at the offloading port 114 or the offshore vessel 106. Moreover, similar to the bladder and port couplings 128, 130, the vessel coupling 138 may comprise a compatible, pressure containing coupling that prevents the accidental discharge of hydrocarbons into the surrounding environment. In some embodiments, as illustrated, the vessel coupling 138 may further include a flexible conduit or hose 140 that provides sufficient length to reach the bladder 120*a-c* at or near the surface.

In some embodiments, securing the connection between the bladder 120*a-c* and the offshore vessel 106 at the couplings 128, 138 may be done manually at the surface. In other embodiments, however, the vessel coupling 138 may comprise an electromechanical coupling capable of being remotely actuated and secured to the bladder coupling 128. Moreover, the connection between the couplings 128, 138 can be established in a manner similar to other subsea hardware; e.g., via locking pins, rotation sequencing, etc., which ensures that mating pieces of the couplings 128, 138 have properly engaged.

To discharge the production fluid (hydrocarbons) from the bladder 120*a-c* into the offshore vessel 106, the bladder valve 132 and a vessel valve 142 may be actuated to the open position. The vessel valve 142 may be actuatable between a closed position, where the production fluids are prevented from entering the offshore vessel 106, and an open position, where production fluids may be received into the offshore vessel 106. Accordingly, one side of the vessel valve 142 is fluidly coupled to one or more internal storage tanks arranged on the offshore vessel 106, and the other side of the vessel valve 142 is configured to receive and connect to the bladder coupling 128 of each bladder 120*a-c*.

Upon properly docking a given bladder 120*a-c* at the offshore vessel 106 and securing the bladder and vessel couplings 128, 138, the valves 132, 142 may be actuated to commence the flow of production fluid (hydrocarbons) from the given bladder 120*a-c* to offshore vessel 106 and, more particularly, to one or more storage containment units 144 included in or otherwise located on the offshore vessel 106. In some embodiments, the valves 132, 142 may be mechanically or electromechanically actuated from a remote location. In such embodiments, once it is determined that the couplings 128, 138 are properly secured, actuation of the valves 132, 142 may be remotely triggered either automatically or through user intervention. In other embodiments, the valves 132, 142 may be manually actuated by a user (e.g., a rig hand) present on the offshore vessel 106 or by using the underwater vehicle 126.

Similar to the bladder and port valves 132, 134, the vessel valve 142 may comprise a type of isolation valve configured to fully isolate the system without leaks. Moreover, the vessel valve 142 may comprise a back pressure valve or a pressure activated gate valve capable of preventing hydrocarbons from exiting the offshore vessel 106 upon disconnection of the couplings 128, 138. The bladders 120*a-c* may be discharged at the offshore vessel 106 until empty or completely empty of production fluid. Once the bladder 120*a-c* is emptied fully or partially, the valves 132, 142 may be actuated to close and thereby stop the flow of production fluid into the offshore vessel 106. The couplings 128, 138 may then be disengaged either manually or automatically (e.g., via remote operation). Upon disengaging from the offshore vessel 106, the bladder 120*a-c* may once again descend into the seawater 102 toward the offloading port 114 to be filled once again, as generally described above.

In some embodiments, instead of connecting to the offshore vessel 106 for discharge or unloading, the filled or substantially filled bladder 120*a-c* may alternatively be directly connected to an onshore infrastructure (not shown) through marine hoses or other pipeline hardware (not shown). In such embodiments, the bladders 120*a-c* may be used not only for production purposes, such as bringing production fluid to the surface, but also for temporary storage purposes. In other embodiments, the filled or substantially filled bladders 120*a-c* may be towed or transported to an onshore facility for discharge, without departing from the scope of the disclosure.

The bladders 120*a-c* may be made of a variety of flexible or semi flexible materials. Example materials for the bladders 120*a-e* include, but are not limited to, natural rubber, synthetic rubber (e.g., halobutyl rubber, brominated isobutylene paramethyl-styrene terpolymer or BIMSM, etc.), chloroprene rubber, acrylonitrile butadiene rubber (NBR), hydrogenated acrylonitrile butadiene rubber (HNBR), a fabric (e.g., nylon, polyester, aramid, steel cord, etc.), or any combination thereof. In some embodiments, the bladders 120*a-c* may include other materials to provide structural integrity including, but not limited to, steel wire (brass or bronze coated), carbon blacks (various grades), etc. In some embodiments, the bladders 120*a-c* may further incorporate or include various rubber chemicals, such as processing oils, accelerators, activators, crosslinking agents, etc.

The bladders 120*a-c* may be formed in and otherwise exhibit a variety of shapes suitable for filling and transporting hydrocarbons. In some embodiments, as illustrated, the bladders 120*a-c* may exhibit a generally spherical shape. Table 1 below provides example volume measurements for various dimensions of a spherical-shaped, flexible bladder (cubic meters to US Barrels (Oil) 1 $m^3$=6.289811US bbl oil).

TABLE 1

| Radius (m) | Volume of Cylinder (cubic meter) | US Barrels (Oil) |
|---|---|---|
| 0.5 | 0.5 | 3.3 |
| 2.5 | 65.5 | 411.8 |
| 5.0 | 523.8 | 3294.7 |
| 7.5 | 1767.9 | 11119.5 |
| 10.0 | 4190.5 | 26357.3 |
| 12.5 | 8184.5 | 51479.1 |
| 15.0 | 14142.9 | 88955.9 |
| 17.5 | 22458.3 | 141258.6 |
| 20.0 | 33523.8 | 210858.4 |
| 22.5 | 47732.1 | 300226.1 |
| 25.0 | 65476.2 | 411832.8 |

In other embodiments, the bladders 120*a-c* may exhibit a generally cylindrical shape. Table 2 below provides example volume measurement for various dimensions of a cylindrically-shaped, flexible bladder.

TABLE 2

| Diameter (m) | Length (m) | Radius (m) | Volume of Cylinder (cubic meter) | US Barrels (Oil) |
|---|---|---|---|---|
| 1 | 60 | 0.5 | 47.1 | 296.5 |
| 2 | 60 | 1 | 188.6 | 1186.1 |
| 3 | 60 | 1.5 | 424.3 | 2668.7 |
| 4 | 60 | 2 | 754.3 | 4744.3 |
| 5 | 60 | 2.5 | 1178.6 | 7413.0 |
| 6 | 60 | 3 | 1697.1 | 10674.7 |
| 7 | 60 | 3.5 | 2310.0 | 14529.5 |
| 8 | 60 | 4 | 3017.1 | 18977.3 |
| 9 | 60 | 4.5 | 3818.6 | 24018.1 |
| 10 | 80 | 5 | 6285.7 | 39535.9 |
| 8 | 80 | 4 | 4022.9 | 25303.0 |
| 10 | 100 | 5 | 7857.1 | 49419.9 |

In yet other embodiments, the bladders 120*a-c* may exhibit other shapes including, but not limited to, a torus (i.e., donut shape), a honeycomb, or any combination of the foregoing. In embodiments where the bladder 120*a-c* is in the shape of a honeycomb, the bladder 120*a-c* may consist of a plurality of hexagonal structures (i.e., mini bladders) fluidly interconnected so that fluids (oil or gas) can pass between each hexagonal structure while filling or draining the bladder 120*a-c*. The honeycomb shape may prove advantageous in in ease of manufacturing, inspection, safety, and transportation.

Figure 2:
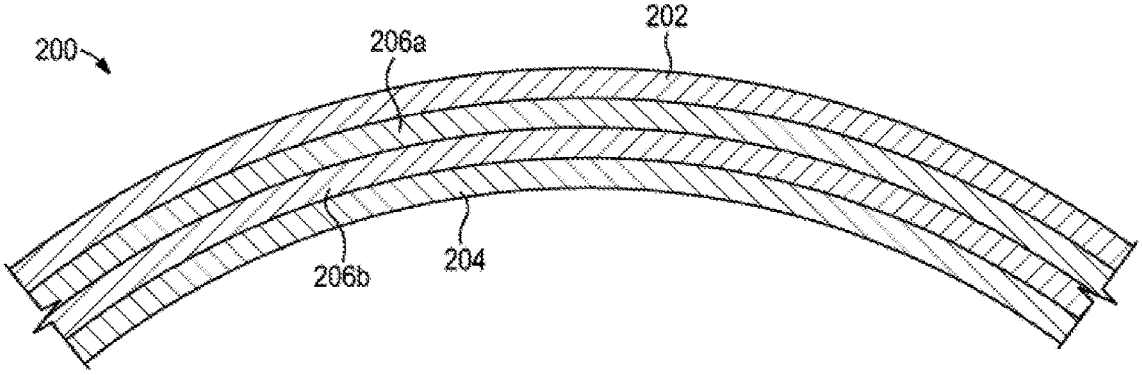
FIG. 2 is a cross-sectional side view of a section of an example bladder 200, according to one or more embodiments of the disclosure.

FIG. 2 is a cross-sectional side view of a section of an example inflatable bladder 200, according to one or more embodiments of the disclosure. The bladder 200 may be the same as or similar to any of the bladders 120*a-c* of FIG. 1. Accordingly, the bladder 200 may be used in conjunction with the system 100 of FIG. 1, as generally described above.

In some embodiments, as illustrated, the bladder 200 may comprise a composite structure made up of two or more layers of materials including at least an outer layer 202 and an inner layer 204. The outer layer 202 will generally be in contact with the water (e.g. the seawater 102 of FIG. 1). Consequently, it may prove advantageous for the outer layer 202 to be made of a material that exhibits salt resistance, water resistance, oil resistance, or any combination thereof. One suitable material for the outer layer 202, for example, is polychloroprene rubber (e.g., Neoprene). Alternatively, the outer layer 202 could be made of one or more synthetic rubbers including, but not limited to, acrylonitrile butadiene rubber (NBR), hydrogenated acrylonitrile butadiene rubber (HNBR), a fluoroelastomer or fluorocarbon (FKM), or any combination or blend thereof. In contrast, the inner layer 204 will be generally in contact with the production fluid (hydrocarbons) within the interior of the bladder 200. Consequently, it may be advantageous for the inner layer 204 to be made of a material that exhibits oil resistance rubber, such as NBR or HNBR. Alternatively, the inner layer 204 may be made of a fluoroelastomer or FKM, or any combination or blend of the foregoing.

In some embodiments, the inner layer 204 may be flexible and collapsible as it will be capable of accommodating a varying volume of an oil well crude stream. In contrast, the outer layer 202 may be semi rigid and may be thicker than the inner layer 204 to enable the outer layer 202 to withstand higher internal and external pressure ratings. It should be noted that the thicknesses of the layers 202, 204 are not drawn to scale in FIG. 2.

In some embodiments, the bladder 200 may include one or more additional layers configured to strengthen the overall structure of the bladder 200 and provide carcass strength to withstand external and internal pressures under deep seawater conditions. In the illustrated embodiment, for example, the bladder 200 includes a first structural layer 206*a* and a second structural layer 206*b*. While two structural layers 206*a,b* are depicted in FIG. 2, more or less than two may be employed, without departing from the scope of the disclosure. In some embodiments, as illustrated, the structural layers 206*a,b* may interpose the outer and inner layers 202, 204.

In some embodiments, the first and second structural layers 206*a,b* may each comprise a fabric ply material (e.g., nylon, polyester, aramid, a metal, etc.) combined with a rubber material. In at least one embodiment, the fabric ply material may comprise a fiber or a wire material. The rubber material can include but is not limited to, an elastomeric isobutylene-isoprene copolymer containing reactive bromine (e.g., bromobutyl rubber), brominated isobutylene paramethyl-styrene terpolymer (BIMSM), natural rubber, or any combination thereof. As will be appreciated, the material makeup of the structural layers 206*a,b* may not only provide structural strength to the bladder 200, but may also enhance the impermeability of crude gases and water. Moreover, the direction of the cords of the fabric ply (e.g., the fiber or the wire) of each of the structural layers 206*a,b* may extend radially or at particular angle. In at least one embodiment, the direction of the cords of the fabric ply of each of the structural layers 206*a,b* may extend in different directions, which may enhance the structural strength of the bladder 200.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the incarnations of the present inventions. At the very least, and not as an attempt to limit the application of the doctrine of equivalents to the scope of the claim, each numerical parameter should at least be construed in light of the number of reported significant digits and by applying ordinary rounding techniques.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While methods are described herein in terms of "comprising" various components or steps, the compositions and methods can also "consist essentially of" or "consist of" the various components and steps.

Embodiments Listing

The present disclosure provides, among others, the following examples, each of which may be considered as optionally including any alternate example.

Clause 1. A method of conveying production fluid from an offshore subsea well includes a) deploying an inflatable bladder from an offshore vessel, the inflatable bladder including a bladder valve, b) fluidly connecting the inflatable bladder to an offloading port positioned at a seafloor, wherein the offloading port includes a port valve and is in fluid communication with one or more subterranean hydrocarbon-bearing formations, c) opening the bladder and port valves to discharge production fluid from the offloading port into the inflatable bladder, and thereby resulting in a substantially filled bladder, d) closing the bladder and port valves, and e) fluidly disconnecting the substantially filled bladder from the offloading port.

Clause 2. The method of Clause 2, further comprising f) returning the substantially filled bladder to the offshore vessel, g) fluidly connecting the substantially filled bladder to the offshore vessel, the offshore vessel including a vessel valve in fluid communication with a storage containment unit located on the offshore vessel, and h) opening the bladder and vessel valves to discharge the production fluid from the substantially filled bladder and into the storage containment unit.

Clause 3. The method of either of Clauses 1 or 2, wherein the inflatable bladder is rigidly coupled to a movable guide wire extending between the offshore vessel and the offloading port, and wherein deploying the inflatable bladder from the offshore vessel further comprises circulating the movable guide wire and thereby conveying the inflatable bladder from the offshore vessel to the offloading port.

Clause 4. The method of any of the preceding Clauses, wherein the inflatable bladder is freely coupled to a stationary guide wire extending between the offshore vessel and the offloading port with a ring that encircles the stationary guide wire, and wherein deploying the inflatable bladder from the offshore vessel further comprises guiding the inflatable bladder through water to the offloading port with the stationary guide wire.

Clause 5. The method of Clause 4, further comprising allowing the inflatable bladder to fall through the water due to the inflatable bladder having a specific gravity greater than a specific gravity of the water.

Clause 6. The method of Clause 4, further comprising guiding the inflatable bladder through the water to the offloading port with an underwater vehicle.

Clause 7. The method of either of Clauses 1 or 2, wherein deploying the inflatable bladder from the offshore vessel further comprises guiding the inflatable bladder through water to the offloading port with an underwater vehicle.

Clause 8. The method of Clause 2, wherein returning the substantially filled bladder to the offshore vessel comprises allowing the inflatable bladder to ascend through water due to the substantially filled inflatable bladder having a specific gravity less than a specific gravity of the water.

Clause 9. The method of Clause 2, further comprising remotely actuating at least one of the bladder valve, the port valve, and the vessel valve.

Clause 10. The method of Clause 2, further comprising manually actuating at least one of the bladder valve, the port valve, and the vessel valve with an underwater vehicle.

Clause 11. The method of Clause 2, further comprising using the substantially filled bladder as a temporary storage system.

Clause 12. The method of Clause 2, further comprising transporting the substantially filled bladder to an onshore facility.

Clause 13. An offshore production and storage system includes a) an offshore vessel including a storage containment unit, b) an inflatable bladder deployable from the offshore vessel and including a bladder coupling and a bladder valve, and c) an offloading port arranged at a seafloor and in fluid communication with one or more hydrocarbon-bearing reservoirs located below the seafloor, the offloading port including a port coupling and a port valve, wherein the bladder coupling is connectable to the port coupling and the bladder and port valves are actuatable to allow production fluids from the one or more hydrocarbon-bearing reservoirs to flow into the inflatable bladder, thereby resulting in a substantially filled bladder.

Clause 14. The system of Clause 13, wherein the offshore vessel further includes a vessel coupling and a vessel valve, and wherein the bladder coupling is connectable to the vessel coupling and the bladder and vessel valves are actuatable to discharge the production fluids from the substantially filled bladder into the storage containment unit.

Clause 15. The system of Clause 14, wherein at least one of the bladder coupling, the port coupling, and the vessel coupling is selected from the group consisting of a mechanical coupling, an electromechanical coupling, a magnetic coupling, and any combination thereof.

Clause 16. The system of Clause 14, wherein at least one of the bladder valve, the port valve, and the vessel valve is remotely actuatable.

Clause 17. The system of Clause 14, wherein at least one of the bladder valve, the port valve, and the vessel valve is manually actuatable using an underwater vehicle.

Clause 18. The system of any of Clauses 13 through 17, wherein the offshore vessel comprises a vessel selected from the group consisting of a floating production, storage, and offloading vessel, a floating storage and offloading vessel, a semisubmersible platform, a floating platform, a tension leg platform, a transport vessel, a fixed platform, a compliant tower, and any combination of the foregoing.

Clause 19. The system of any of Clauses 13 through 18, further comprising a guide wire extending between the offshore vessel and the offloading port.

Clause 20. The system of Clause 19, wherein the inflatable bladder is rigidly coupled to the guide wire and the guide wire is movable to convey the bladder between the offshore vessel and the offloading port.

Clause 21. The system of Clause 19, wherein the inflatable bladder is freely coupled to the guide wire at a ring that encircles the guide wire.

Clause 22. The system of Clause 13, further comprising an underwater vehicle that conveys the inflatable bladder between the offshore vessel and the offloading port.

Clause 23. The system of any of Clauses 13 through 22, wherein the inflatable bladder is made of a of flexible or semi flexible material selected from the group consisting of natural rubber, synthetic rubber, chloroprene rubber, acrylonitrile butadiene rubber, hydrogenated acrylonitrile butadiene rubber, a fabric, a fluoroelastomer or fluorocarbon, and any combination thereof.

Clause 24. The system of any of Clauses 13 through 22, wherein the inflatable bladder comprises a composite structure including an outer layer made of a saltwater resistant material and an inner layer made of an oil resistant material.

Clause 25. The system of Clause 24, further comprising one or more structural layers interposing the outer and inner layers and comprising at least one structural strength material.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method of conveying production fluid from an offshore subsea well, the method comprising:

a) deploying an inflatable bladder from an offshore vessel, the inflatable bladder including a bladder valve;

b) fluidly connecting the inflatable bladder to an offloading port positioned at a seafloor, wherein the offloading port includes a port valve and is in fluid communication with one or more subterranean hydrocarbon-bearing formations located below the seafloor;

c) opening the bladder and port valves to discharge production fluid from the offloading port into the inflatable bladder;

d) monitoring with one or more sensors at least one of i) a pressure inside the inflatable bladder, ii) a volume of production fluid inside the inflatable bladder, or iii) a flowrate into the inflatable bladder;

e) closing the bladder and port valves when i), ii), or iii) reaches a predetermined value, thereby resulting in a substantially filled bladder; and f) fluidly disconnecting the substantially filled bladder from the offloading port.

2. The method of claim 1, further comprising:

g) returning the substantially filled bladder to the offshore vessel;

h) fluidly connecting the substantially filled bladder to the offshore vessel, the offshore vessel including a vessel valve in fluid communication with a storage containment unit located on the offshore vessel; and i) opening the bladder and vessel valves to discharge the production fluid from the substantially filled bladder and into the storage containment unit.

3. The method of claim 1, wherein the inflatable bladder is rigidly coupled to a movable guide wire extending between the offshore vessel and the offloading port, and wherein deploying the inflatable bladder from the offshore vessel further comprises circulating the movable guide wire and thereby conveying the inflatable bladder from the offshore vessel to the offloading port.

4. The method of claim 1, wherein the inflatable bladder is freely coupled to a stationary guide wire extending between the offshore vessel and the offloading port with a ring that encircles the stationary guide wire, and wherein deploying the inflatable bladder from the offshore vessel further comprises guiding the inflatable bladder through water to the offloading port with the stationary guide wire.

5. The method of claim 4, further comprising allowing the inflatable bladder to fall through the water due to the inflatable bladder having a specific gravity greater than a specific gravity of the water.

6. The method of claim 4, further comprising guiding the inflatable bladder through the water to the offloading port with an underwater vehicle.

7. The method of claim 1, wherein deploying the inflatable bladder from the offshore vessel further comprises guiding the inflatable bladder through water to the offloading port with an underwater vehicle.

8. The method of claim 2, wherein returning the substantially filled bladder to the offshore vessel comprises allowing the inflatable bladder to ascend through water due to the substantially filled inflatable bladder having a specific gravity less than a specific gravity of the water.

9. The method of claim 2, further comprising remotely actuating at least one of the bladder valve, the port valve, and the vessel valve.

10. The method of claim 2, further comprising manually actuating at least one of the bladder valve, the port valve, and the vessel valve with an underwater vehicle.

11. The method of claim 2, further comprising using the substantially filled bladder as a temporary storage system.

12. The method of claim 2, further comprising transporting the substantially filled bladder to an onshore facility.

13. An offshore production and storage system, comprising:

a) an offshore vessel including a storage containment unit;

b) an inflatable bladder deployable from the offshore vessel and including a bladder coupling and a bladder valve;

c) an offloading port arranged at a seafloor and in fluid communication with one or more hydrocarbon-bearing reservoirs located below the seafloor, the offloading port including a port coupling and a port valve, wherein the bladder coupling is connectable to the port coupling and the bladder and port valves are actuatable to allow production fluids from the one or more hydrocarbon-bearing reservoirs to flow into the inflatable bladder, thereby resulting in a substantially filled bladder; and d) one or more sensors that monitor at least one of i) a pressure inside the inflatable bladder, ii) a volume of production fluid inside the inflatable bladder, or iii) a flowrate into the inflatable bladder, wherein the bladder and port valves are closable when i), ii), or iii) reaches a predetermined value, thereby resulting in the substantially filled bladder.

14. The system of claim 13, wherein the offshore vessel further includes a vessel coupling and a vessel valve, and wherein the bladder coupling is connectable to the vessel coupling and the bladder and vessel valves are actuatable to discharge the production fluids from the substantially filled bladder into the storage containment unit.

15. The system of claim 14, wherein at least one of the bladder coupling, the port coupling, and the vessel coupling is selected from the group consisting of a mechanical coupling, an electromechanical coupling, a magnetic coupling, and any combination thereof.

16. The system of claim 14, wherein at least one of the bladder valve, the port valve, and the vessel valve is remotely actuatable.

17. The system of claim 14, wherein at least one of the bladder valve, the port valve, and the vessel valve is manually actuatable using an underwater vehicle.

18. The system of claim 13, wherein the offshore vessel comprises a vessel selected from the group consisting of a floating production, storage, and offloading vessel, a floating storage and offloading vessel, a semisubmersible platform, a floating platform, a tension leg platform, a transport vessel, a fixed platform, a compliant tower, and any combination of the foregoing.

19. The system of claim 13, further comprising a guide wire extending between the offshore vessel and the offloading port.

20. The system of claim 19, wherein the inflatable bladder is rigidly coupled to the guide wire and the guide wire is movable to convey the bladder between the offshore vessel and the offloading port.

21. The system of claim 19, wherein the inflatable bladder is freely coupled to the guide wire at a ring that encircles the guide wire.

22. The system of claim 13, further comprising an underwater vehicle that conveys the inflatable bladder between the offshore vessel and the offloading port.

23. The system of claim 13, wherein the inflatable bladder is made of a flexible or semi flexible material selected from the group consisting of natural rubber, synthetic rubber, chloroprene rubber, acrylonitrile butadiene rubber, hydrogenated acrylonitrile butadiene rubber, a fabric, a fluoroelastomer or fluorocarbon, and any combination thereof.

24. The system of claim 13, wherein the inflatable bladder comprises a composite structure including an outer layer made of a saltwater resistant material and an inner layer made of an oil resistant material.

25. The system of claim 24, further comprising one or more structural layers interposing the outer and inner layers and comprising at least one structural strength material.

* * * * *